US006629698B2

(12) United States Patent
Chu

(10) Patent No.: US 6,629,698 B2
(45) **Date of Patent: *Oct. 7, 2003**

(54) MULTIFUNCTIONAL SHOE

(76) Inventor: Wei-Yen Chu, No. 261, Ta Chu Road, Lu Chu Hsiang, Taoyuan Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/968,901

(22) Filed: Oct. 3, 2001

(65) Prior Publication Data

US 2003/0062697 A1 Apr. 3, 2003

(51) Int. Cl.[7] ..... A63C 17/00

(52) U.S. Cl. ..... 280/11.19; 280/7.13; 280/9; 280/11.211; 36/115

(58) Field of Search ..... 280/11.19, 7.13, 280/11.221, 11.217, 9, 7.12, 11.211, 11.206, 11.208, 11.225; 36/115

(56) References Cited

U.S. PATENT DOCUMENTS 2,095,942 A * 10/1937 Wetterstrand ..... 280/7.13
2,644,692 A * 7/1953 Kahlert ..... 280/11.221
3,884,485 A * 5/1975 Walle ..... 280/841
3,979,842 A * 9/1976 Texidor ..... 36/115
3,983,643 A * 10/1976 Schreyer et al. ..... 36/115
4,333,249 A * 6/1982 Schaefer ..... 36/115
5,398,970 A * 3/1995 Tucky ..... 280/841
5,511,824 A * 4/1996 Kim ..... 280/841
5,785,327 A * 7/1998 Gallant ..... 280/11.27
5,797,609 A * 8/1998 Fichepain ..... 280/11.19
5,803,469 A * 9/1998 Yoham ..... 280/11.27
5,882,018 A * 3/1999 Petrosino ..... 280/7.13
5,934,692 A * 8/1999 Artus ..... 280/11.225
6,042,125 A * 3/2000 Wu ..... 280/11.27
6,120,039 A * 9/2000 Clementi ..... 280/11.19
6,247,708 B1 * 6/2001 Hsu ..... 280/11.223
6,308,964 B1 * 10/2001 Chang ..... 280/11.19
6,364,322 B1 * 4/2002 Lee ..... 280/11.27
6,386,555 B1 * 5/2002 Kao ..... 280/7.13
6,406,037 B2 * 6/2002 Chang ..... 280/11.19
6,412,791 B1 * 7/2002 Chu ..... 280/11.19
6,454,279 B1 * 9/2002 Yang ..... 280/11.223
6,464,236 B2 * 10/2002 Chang ..... 280/11.223
6,474,661 B1 * 11/2002 Chang ..... 280/11.19

* cited by examiner

*Primary Examiner*—Brian L. Johnson
*Assistant Examiner*—Kelly E Campbell
(74) *Attorney, Agent, or Firm*—Rosenberg, Klein & Lee

(57) ABSTRACT

The present invention relates to a multifunctional shoe which includes a shoe, a locating part, a sliding device and a locking device. The shoe has a sole provided with at least an accommodation. The locating part is fixed by a fixing member inside the accommodation and is a hollow body with the opening thereof is directed downward, thereby forming a mounting opening at the bottom of the sole. The sliding device contains a wheel and a wheel base. The wheel base corresponds to the locating part in form so that it can be received in the locating part. The locking device is located at the side of the locating part. A lock pin is disposed inside the locking device and is controllable from the outside of the sole to be axially moved. The sliding device is fixed inside the locking device while the small part of the wheel projects from the sole for sliding purpose; moreover, the sliding device can be stored or disassembled without projection on the sole for walking purpose.

7 Claims, 16 Drawing Sheets

MULTIFUNCTIONAL SHOE

BACKGROUND OF THE INVENTION

1. Field of the Invention

The present invention relates to a multifunctional shoe, and more particularly to a shoe with both sliding and walking functions.

2. Description of the Prior Art

A conventional in-line skate, as shown in FIG. 1, has a set of wheel (b) at the bottom of the shoe body (a). A great height (H1) from the bottom of the shoe body (a) amounts to at least 6 cm. When the beginner wear it, it's easy for him to fall down on his back with legs pointing up because of the higher center of the gravity and the unbalance, thereby even causing the injury of the buttocks through shock to the ground and the learning fear to give up further practice.

In accordance with researches, the skating motion is dependent upon the sense of balance. After grasping the sense of balance, the beginner can easily learn the skating. It is like that to ride motorcycle is very easy when one is able to ride bicycle. Therefore, it's the main topic of the present invention how to learn skating without falling to the ground and how to train the sense of balance.

Meanwhile, the conventional in-line skates can be used for skating purpose only, and can't be used for walking. Thus, the roller skater has to carry the skate to a skating place and then wear it, thereby causing much trouble.

In order to increase the functions of the shoe, a "sole of roller shoes" disclosed by TW Pat. No. 367879, as shown in FIG. 1(A), and a "shoe for walking and skating" disclosed by TW Pat. No. 400753 are known as prior arts. In these two disclosures, a conventional shoe is provided with rollers (c) on the sole in a projecting or hidden position, thereby creating the skating function of a shoe. However, the bottom of the holding groove (d) has to be open in order to store or pull out the rollers 7, thereby accumulating impurities and therefore causing malfunction of the rollers (e.g. the rollers are easily blocked by the impurities). Moreover, the pivot (e) of the rollers (c) is fitted with strong spring (not shown) inside so that the stored rollers won't fall down. However, it takes much effort to bring out the rollers in place for skating, and it's almost impossible for children to do it. In addition, the height after using the rollers (c) is almost the same to the height (H1) of the common roller skate. Thus, this height is also not suitable for the beginner for practice and training the sense of balance.

SUMMARY OF THE INVENTION

It is a primary object of the present invention to provide a multifunctional shoe which can be used as a common shoe at ordinary times and changed to be sliding shoe at any time to help the beginner to train the sense of balance and protect him from injuries during skating.

It is another object of the present invention to provide a multifunctional shoe which is safe in use while the fun during exercise session is enhanced.

It is a further object of the present invention to provide a multifunctional shoe which is easy, convenient and effortless in operation and in use.

BRIEF DESCRIPTION OF THE DRAWINGS

The accomplishment of this and other objects of the invention will become apparent from the following description and its accompanying drawings of which:

FIG. 1(A) is a schematic drawing of a prior art disclosed in TW 367879;

DETAILED DESCRIPTION OF THE PREFERRED EMBODIMENT

Figure 1:
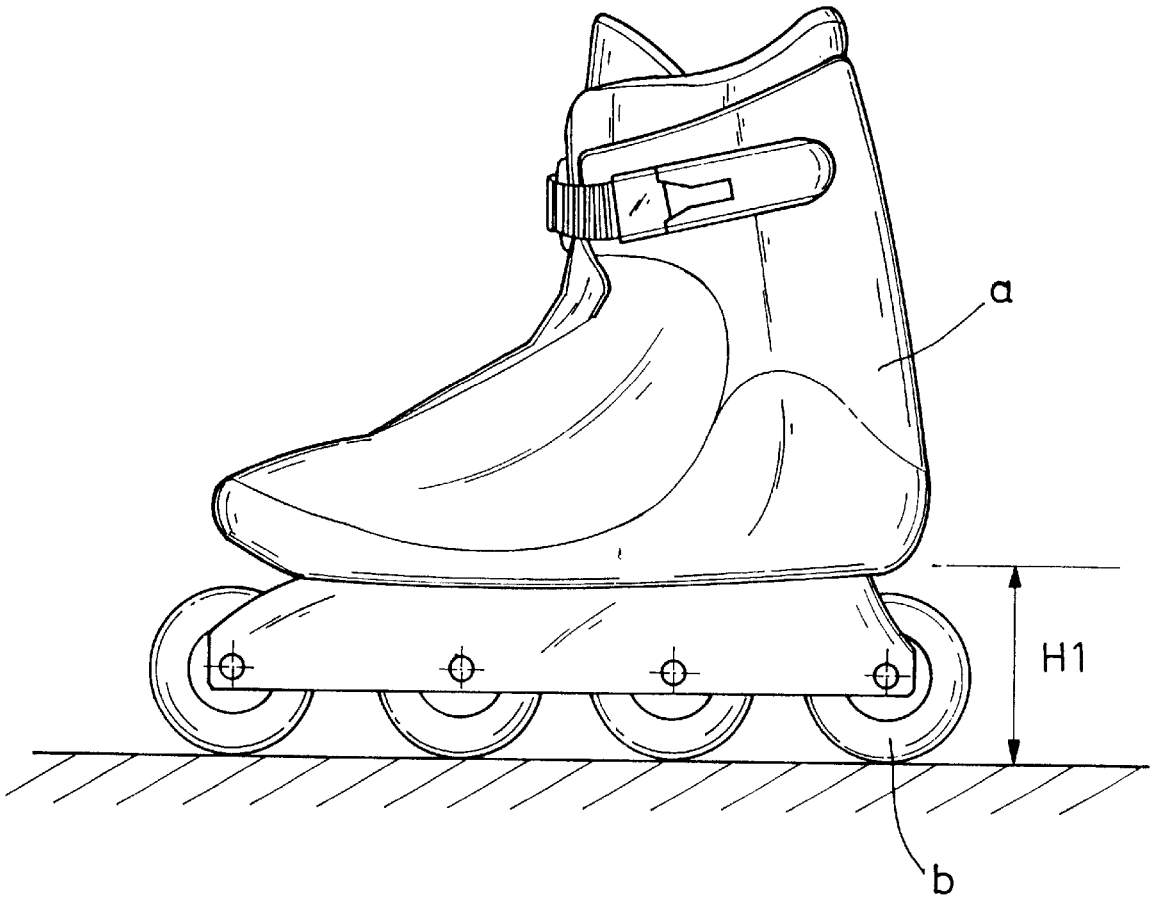
FIG. 1 PRIOR ART
FIG. 1 is a schematic drawing of a conventional in-line skate.
Figure 1:
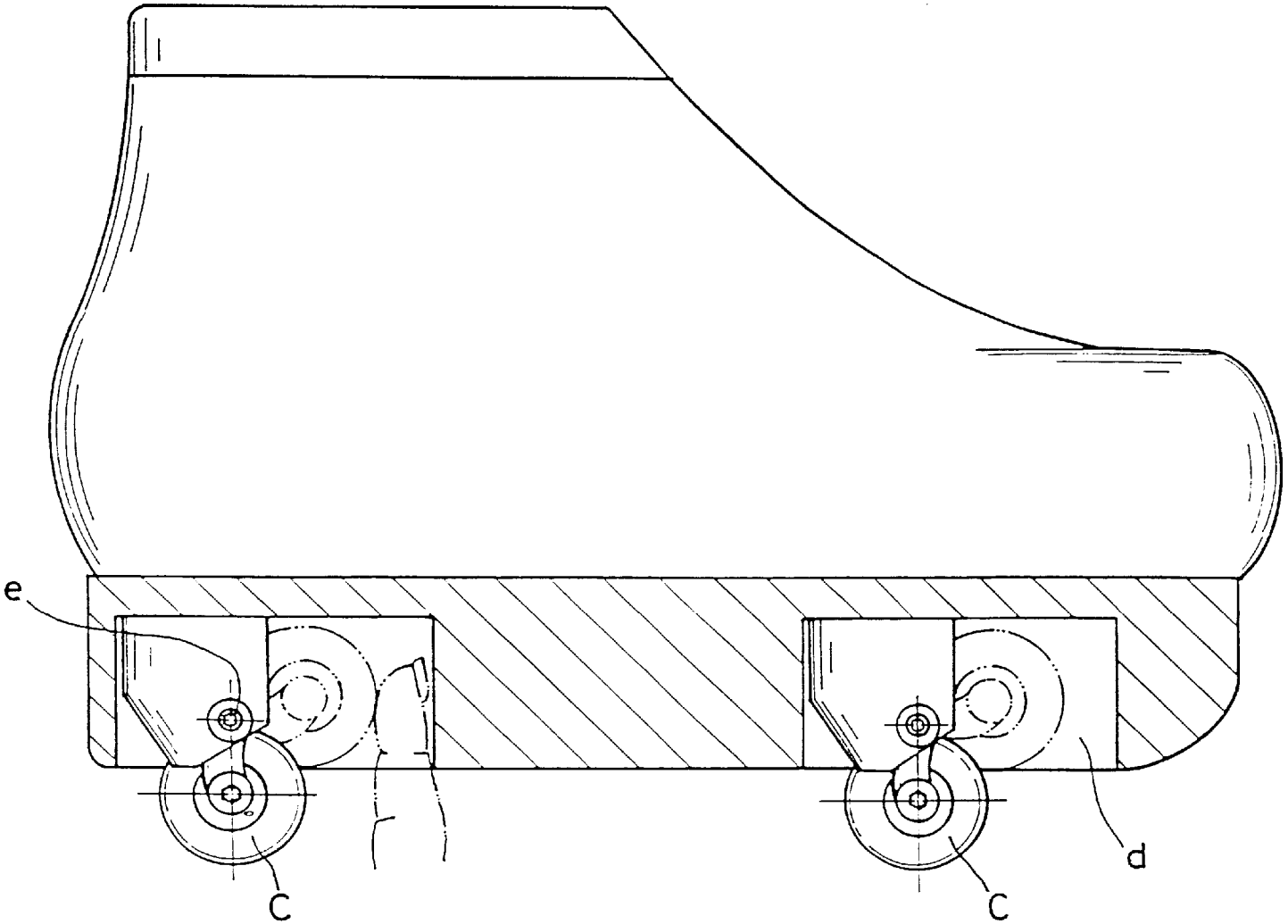
FIG. 1 (A) PRIOR ART
Figure 2:
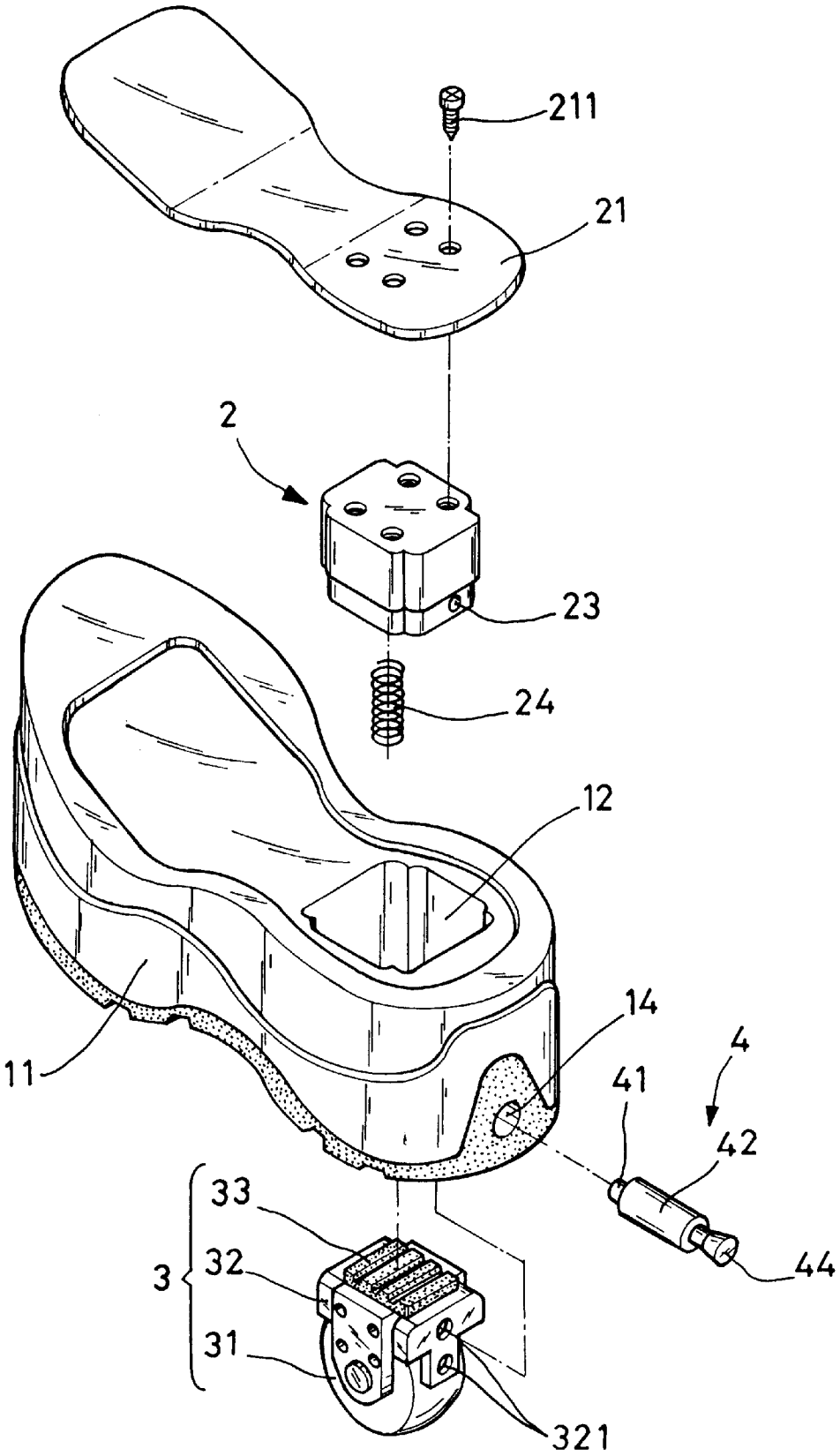
FIG. 2 is a perspective exploded view of a first embodiment of the present invention.
Figure 3:
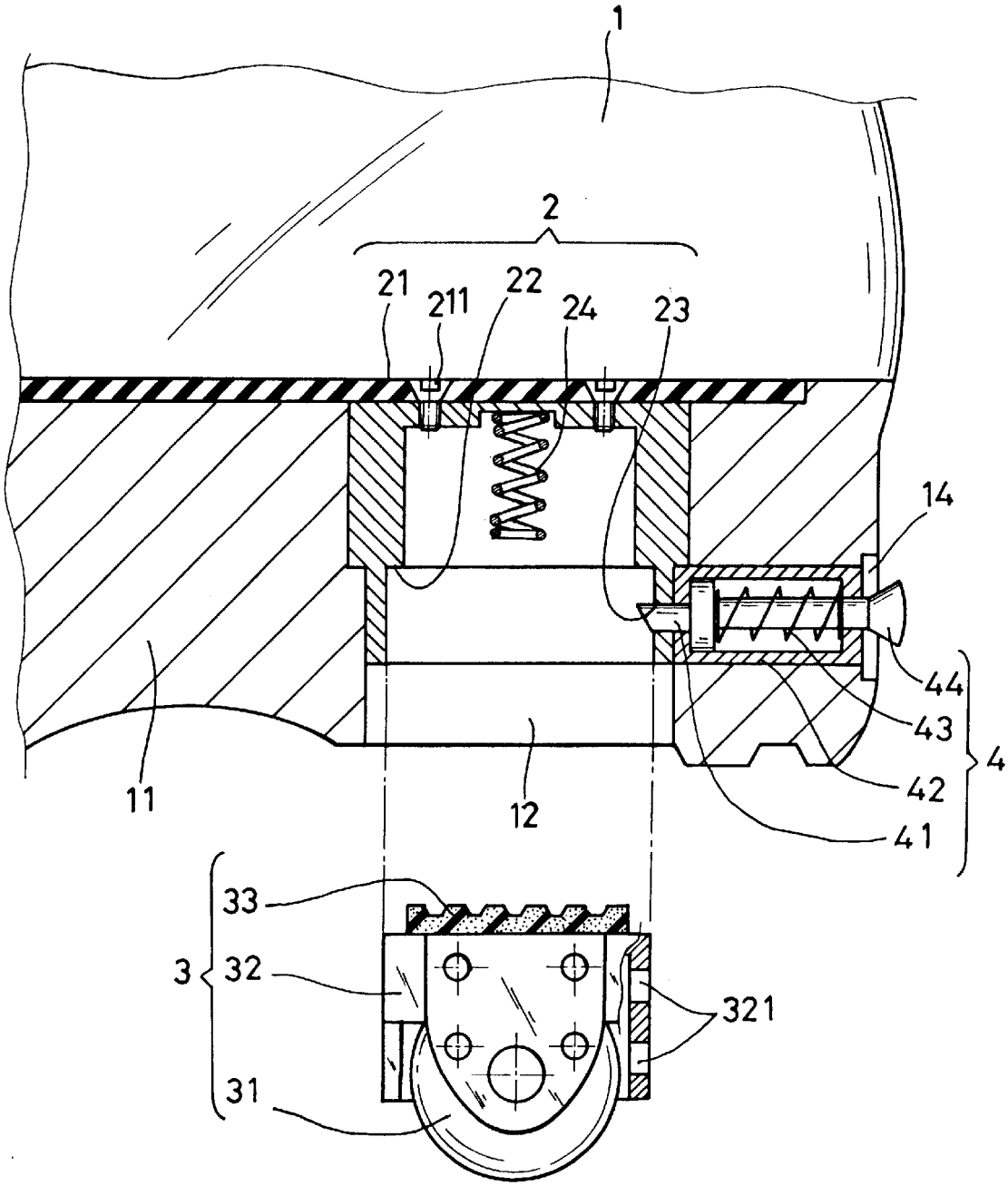
FIG. 3 is an exploded sectional view of the main structure of the first embodiment of the present invention.
Figure 4:
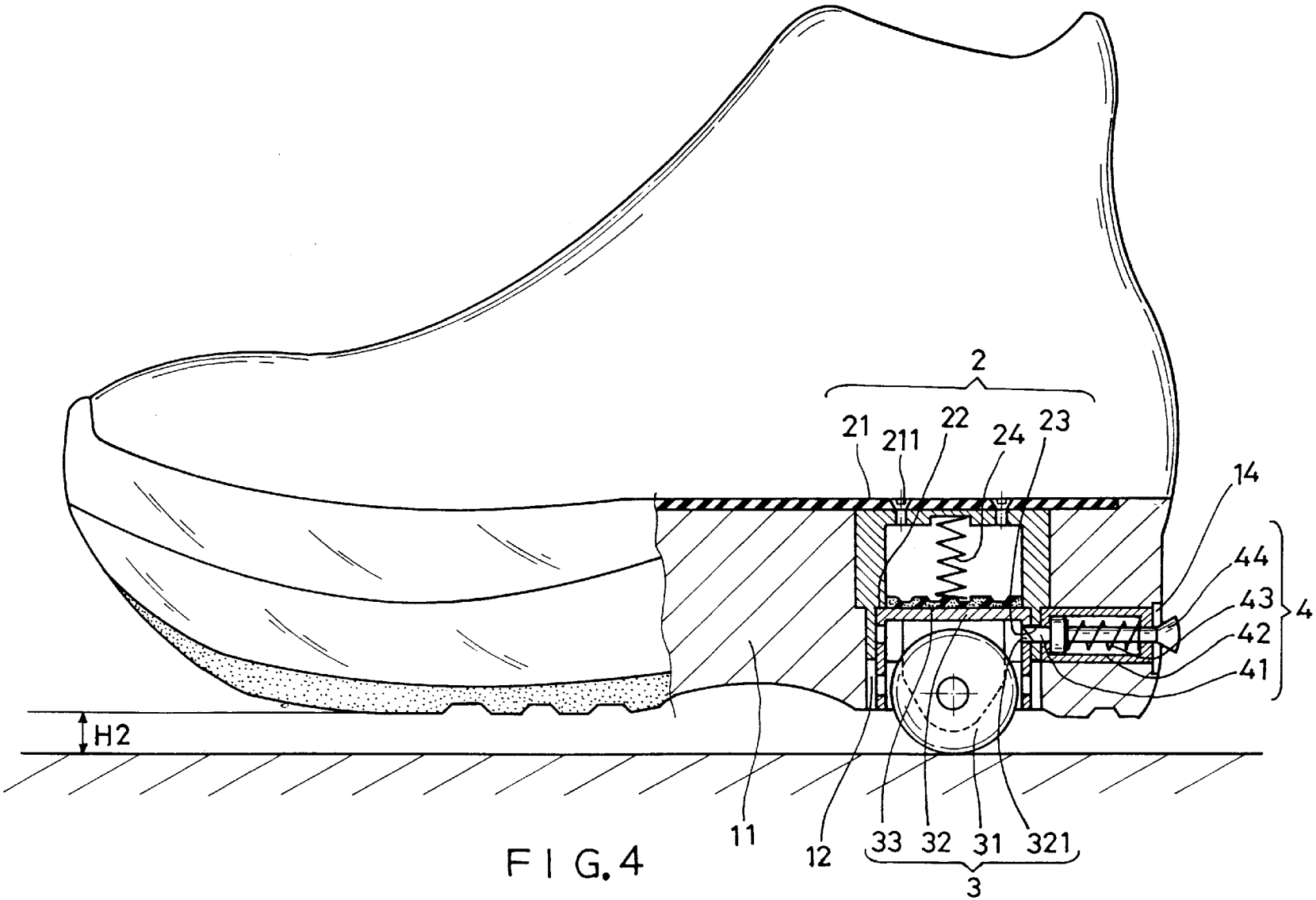
FIG. 4 is a sectional assembly view of the first embodiment of the present invention illustrating the shoe in a sliding state.

First of all, referring to FIGS. 2 through 4, the multifunctional shoe of a first embodiment in accordance with the present invention includes a shoe 1, a locating part 2, a sliding device 3 and a locking device 4.

The shoe 1 has a sole 11 provided with at least an accommodation 12.

The locating part 2 is fixed by a fixing member 21 inside the accommodation 12 and is a hollow body with the opening thereof is directed downward, thereby forming a mounting opening at the bottom of the sole 11. Moreover, the locating part 2 has a locating surface 22 at a preset height on the inner wall of the locating part 2. And a through hole 23 is disposed at the side near the bottom of the locating part 2.

The sliding device 3 contains a wheel 31 and a wheel base 32. The wheel base 32 corresponds to the locating part 2 in form so that it can be received in the locating part 2 in contact against the locating surface 22. A locating hole 321 corresponding to the through hole 23 of the locating part 2 is disposed at the side of the sliding device 3.

The locking device 4 is located at the side of the locating part 2. A lock pin 41 is disposed inside the locking device 4 and is controllable from the outside of the sole 11 to be axially moved into or retracted from the through hole 23 of the locating part 2 and the locating hole 321 of the wheel base 32.

Based on the above-mentioned structure, the locating part 2 is received in the accommodation 12 of the sole 11 and fixed by the fixing member 21 which is constructed as a fixing plate and secured by screws 211 to the locating part 2. Alternatively, the locating part 2 and the fixing member 21 can be formed in a body.

A compression spring 24 is arranged on the inner top surface of the locating part 2. In addition, a rubber pad 33 is fitted to the top surface of the wheel base 32.

Furthermore, the locking device 4 contains a lock pin 41 axially movable in the casing 42. A spring 43 is inserted on the middle part of the lock pin 41 while the lock pin 41 projects from the casing 42 to create a holding head 44 near a through hole 14 at the side of the sole 11.

As shown in FIG. 3, the wheel base 32 is directed upward and inserted into the locating surface 22 in place so that the wheel base 32 is enclosed by the locating part 2, as illustrated in FIG. 4, so that the sliding device 3 doesn't shake. Moreover, the lock pin 41 of the locking device 4 is inserted through the through hole 23 of the locating part 2 into the corresponding locating hole 321 at the side of the sliding device 3. Accordingly, the sliding device 3 won't fall out of the locating part 2.

Figure 5:
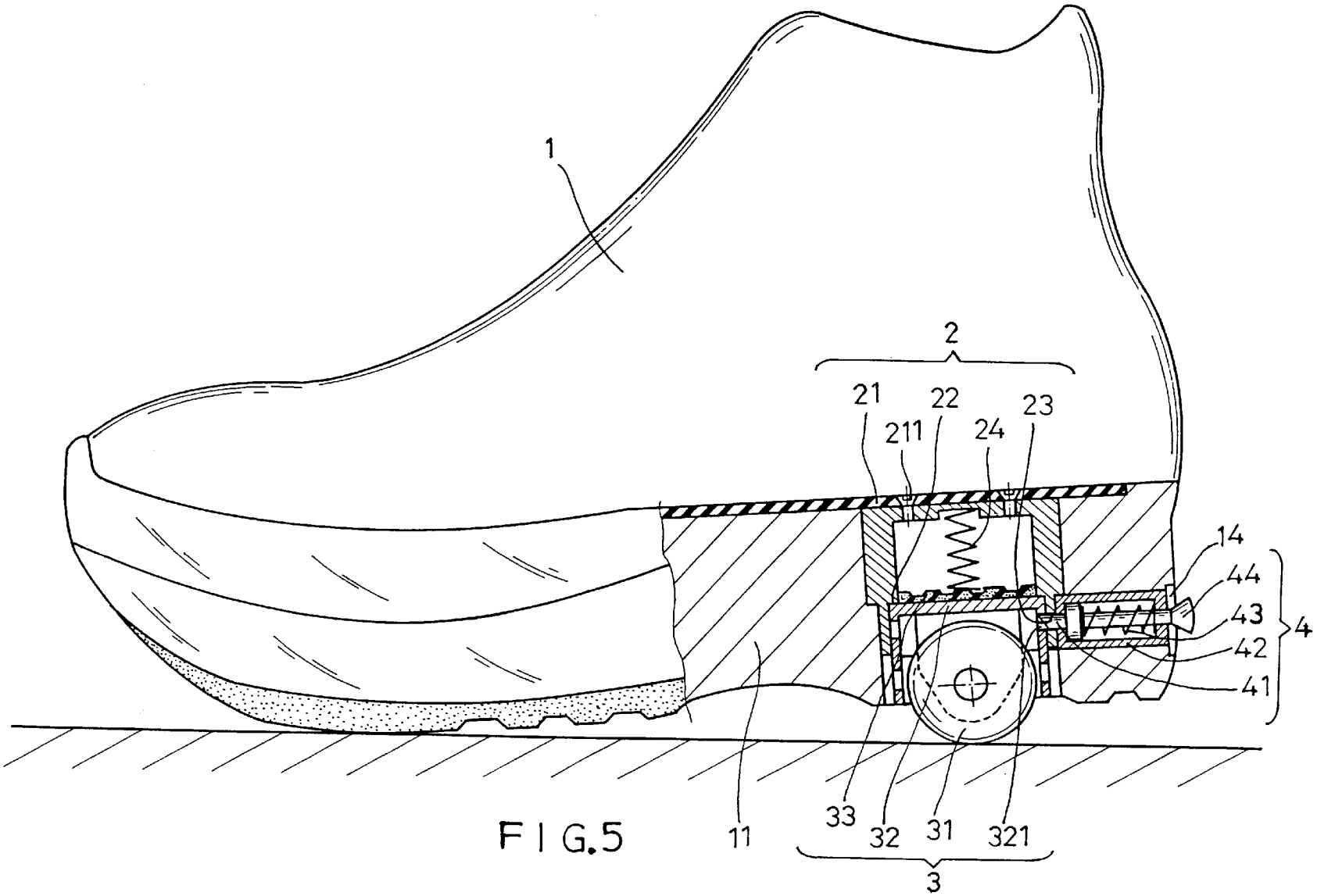
FIG. 5 is a sectional assembly view of the first embodiment of the present invention illustrating the shoe in a walking state.
Figure 6:
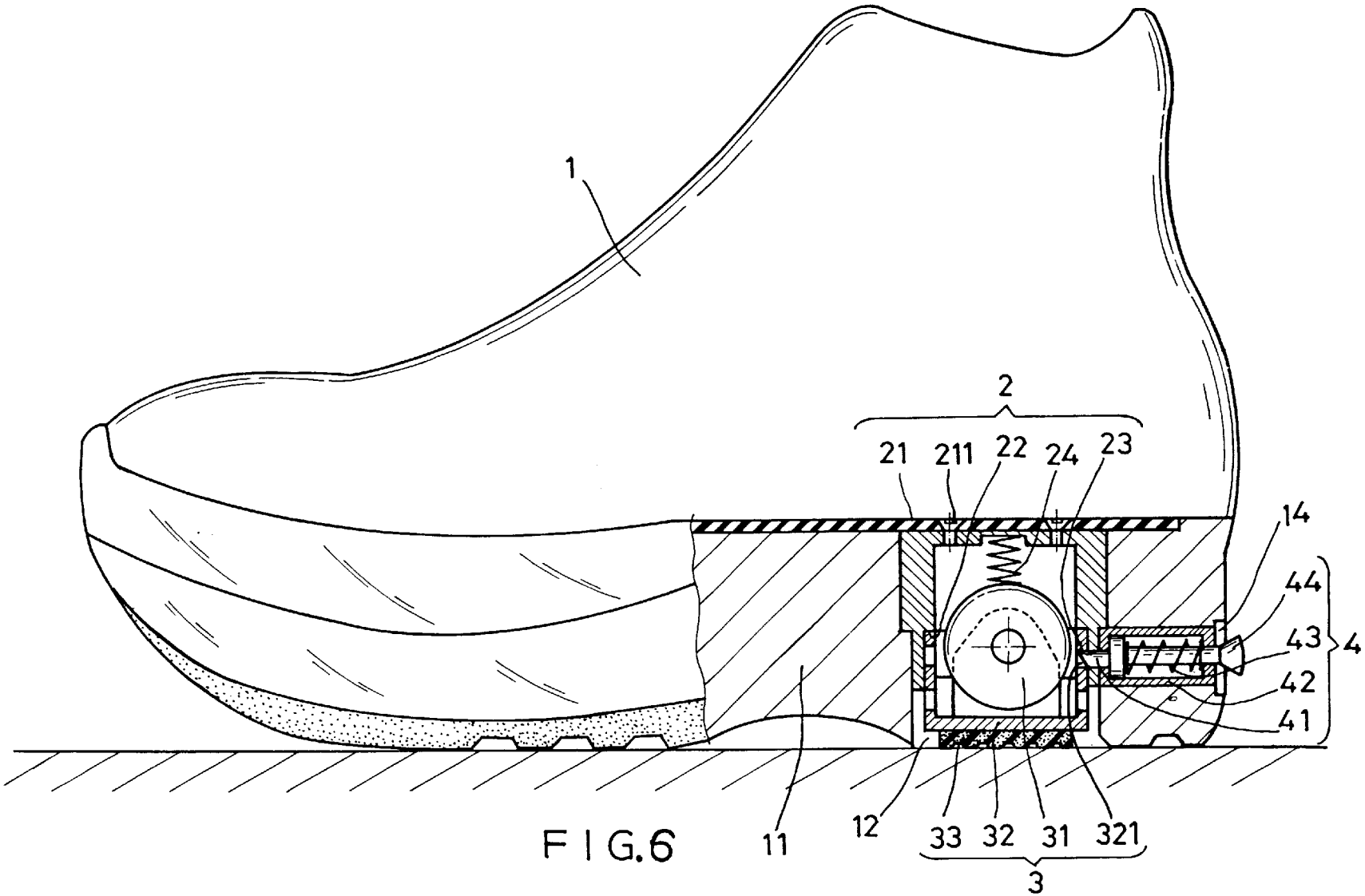
FIG. 6 is a sectional assembly view of the first embodiment of the present invention for walking only while the wheels thereof are stored in an accommodation.

As shown in FIG. 4, the wheel 31 of the sliding device 3 slightly projects from the sole 11. The small height (H2) to the ground is used for the user to practice the sense of balance while sliding. When the beginner loses his balance, the balance can be restored by using the front end of the shoe 1 to touch the ground (see FIG. 5) so that the danger of falling to the ground can be avoided. Accordingly, the present invention can serve as a sliding shoe in addition to practice of sense of balance. It's full of fun and equated with the conventional roller skate or the in-line skate. Moreover, when the shoe 1 is not used for sliding, it can serve as a shoe with low heel for walking on the ground. Furthermore, as shown in FIG. 6, the wheel 31 of the sliding device 3 is pushed upward into the locating part 2 while the lock pin 41 of the locking device 4 is inserted into the locating hole 321 of the wheel base 32. Thus, the sliding device 3 is reversely stored inside the locating part 2. Meanwhile, the rubber pad 33 is directed downward to be in line with the sole 11 so that the shoe 1 is the same to the common shoes for walking purpose. It's very practical. When it's desired to make sliding movement, the holding head 44 is pulled outward so that the lock pin 41 is separate from the locating hole 321. Meanwhile, the sliding device 3 is smoothly pushed outwards by means of the resilience of the compression spring 24 inside the locating part 2. Thereafter, the sliding device 3 is turned over to be in the sliding state and restores itself, as shown in FIG. 4.

Figure 7:
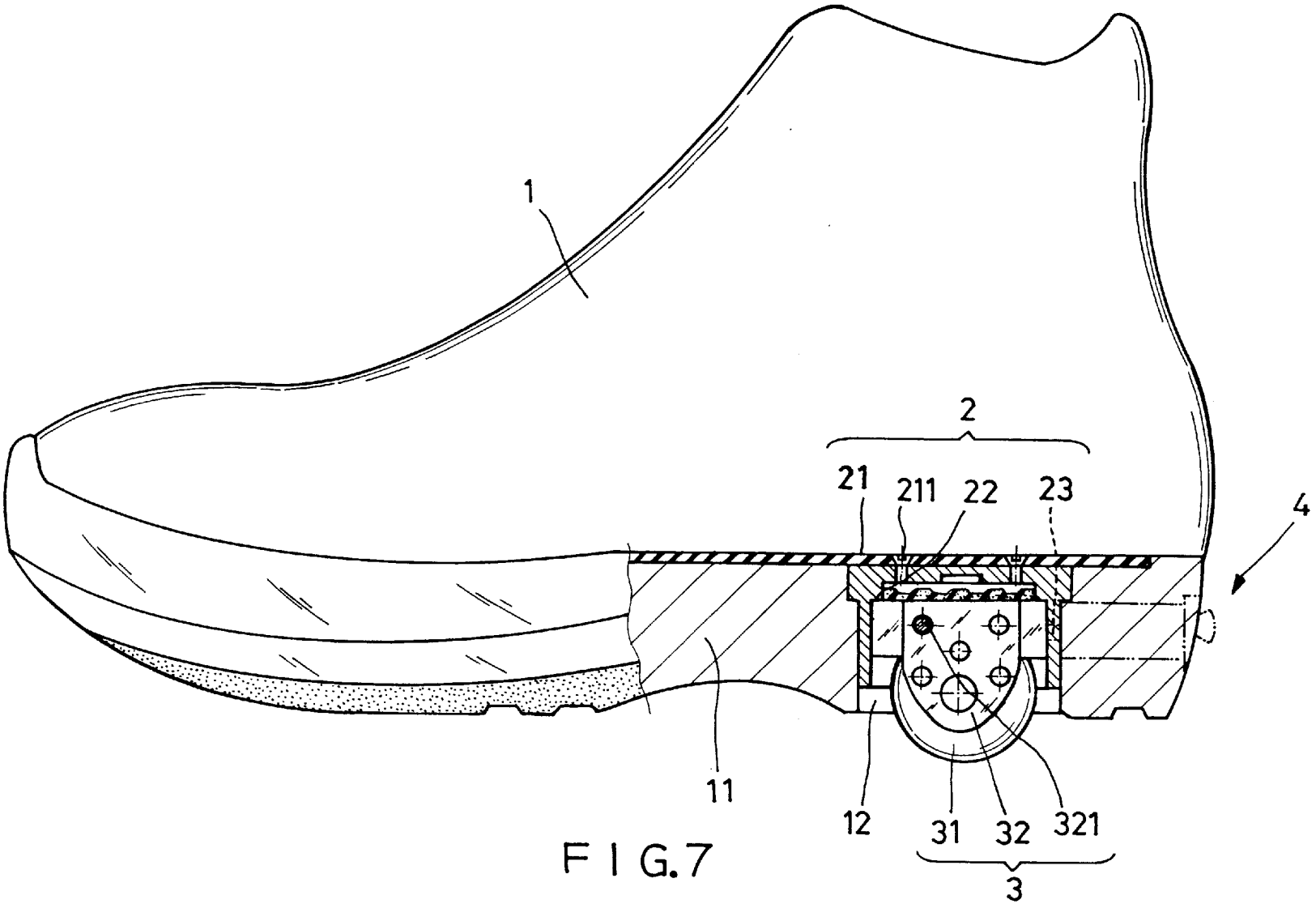
FIG. 7 is a schematic drawing of a second embodiment of the present invention illustrating the wheels in a slidable state.

FIG. 7 illustrates a second embodiment of the present invention. In this second embodiment, the thickness of the sole 11 is reduced so that the accommodation 12 and the locating part 2 inside the accommodation 12 are correspondingly lowered. The sliding device 3 is fitted in the forward direction inside the locating part 2 and fixed by the locking device 4. The locking device 4 can be installed not only at the rear side of the sole 11 but also at the right and left sides thereof. Moreover, the locking device 4 is fixed by the corresponding locating holes 321 at both sides of the wheel base 32. The descriptions of the detailed structure are given hereinafter.

Figure 8:
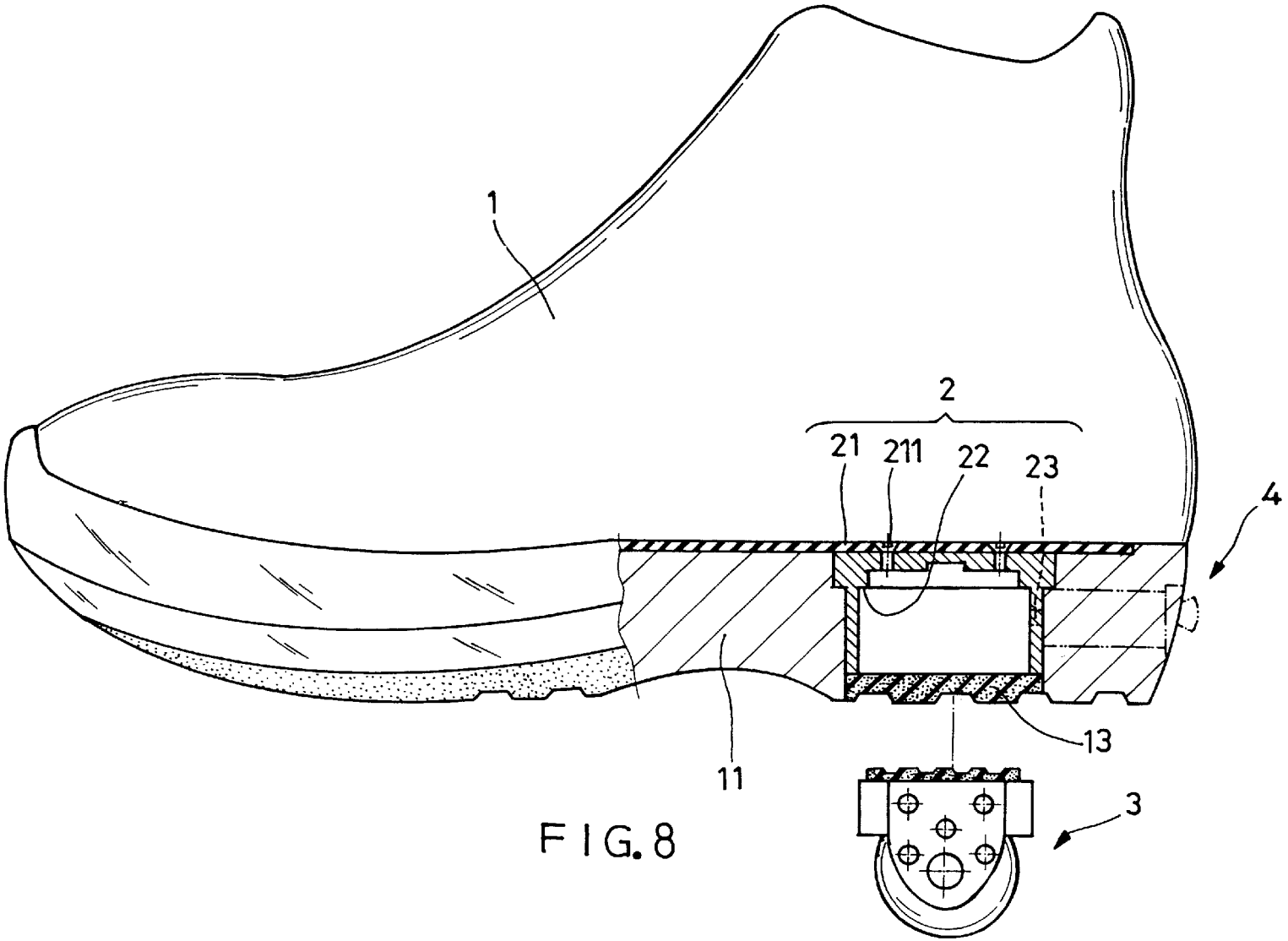
FIG. 8 is a schematic drawing of the second embodiment of the present invention for walking only while the wheels thereof are disassembled.

FIG. 8 shows a schematic drawing of the disassembled sliding device 3 illustrated in FIG. 7. This second embodiment has only limited accommodation space so that the sliding device 3 can't be reversely stored in the locating part 2. Thus, a rubber cover 13 is required to seal the mounting opening so that the shoe 1 of the second embodiment of the present invention is identical with the common shoes. This embodiment has the lightweight feature and is suitable for the leisure shoes.

In the first and second embodiments, the sliding device 3 and the locating part 2 are independent without any connection. Accordingly, the sliding device 3 can be removed from the locating part 2. In the next embodiment of the present invention, the sliding device 3 and the locating part 2 are connected.

Referring to FIGS. 9 through 13, most of the structure the third embodiment is identical with most of the structure of the first and second embodiments so that the detailed descriptions won't be given hereinafter again, but the additional components are described as follows. The locating part 2 has a longitudinal through hole 25 at both sides thereof to receive two mounting rods 26 which are inserted from the top to the bottom of the longitudinal through hole 25. Moreover, both mounting rods 26 are up and down movable in the longitudinal through hole 25. The mounting rods 26 are provided with a slot 261 at the lower part and a hook 262 at the upper part thereof. The wheel base 32 of the sliding device 3 includes a tapped hole 322 in the middle of either side thereof. A screw 34 passes through the slot 261 of the mounting rods 26 in order to locate the sliding device 3 between both mounting rods 26. Meanwhile, the slot 261 serves as turning point in order to turn the sliding device 3 upside down.

Figure 9:
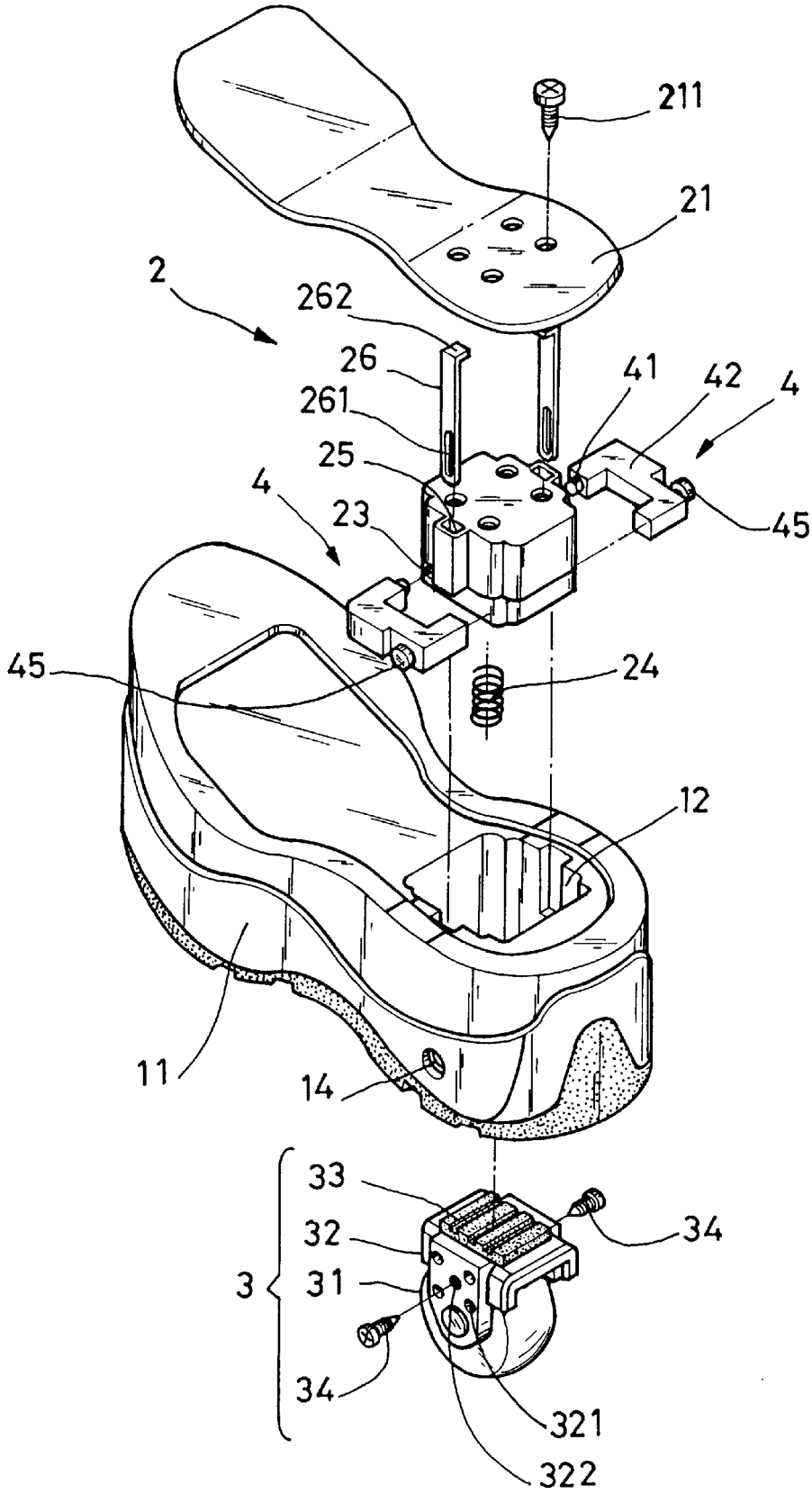
FIG. 9 is a perspective exploded view of a third embodiment of the present invention.
Figure 10:
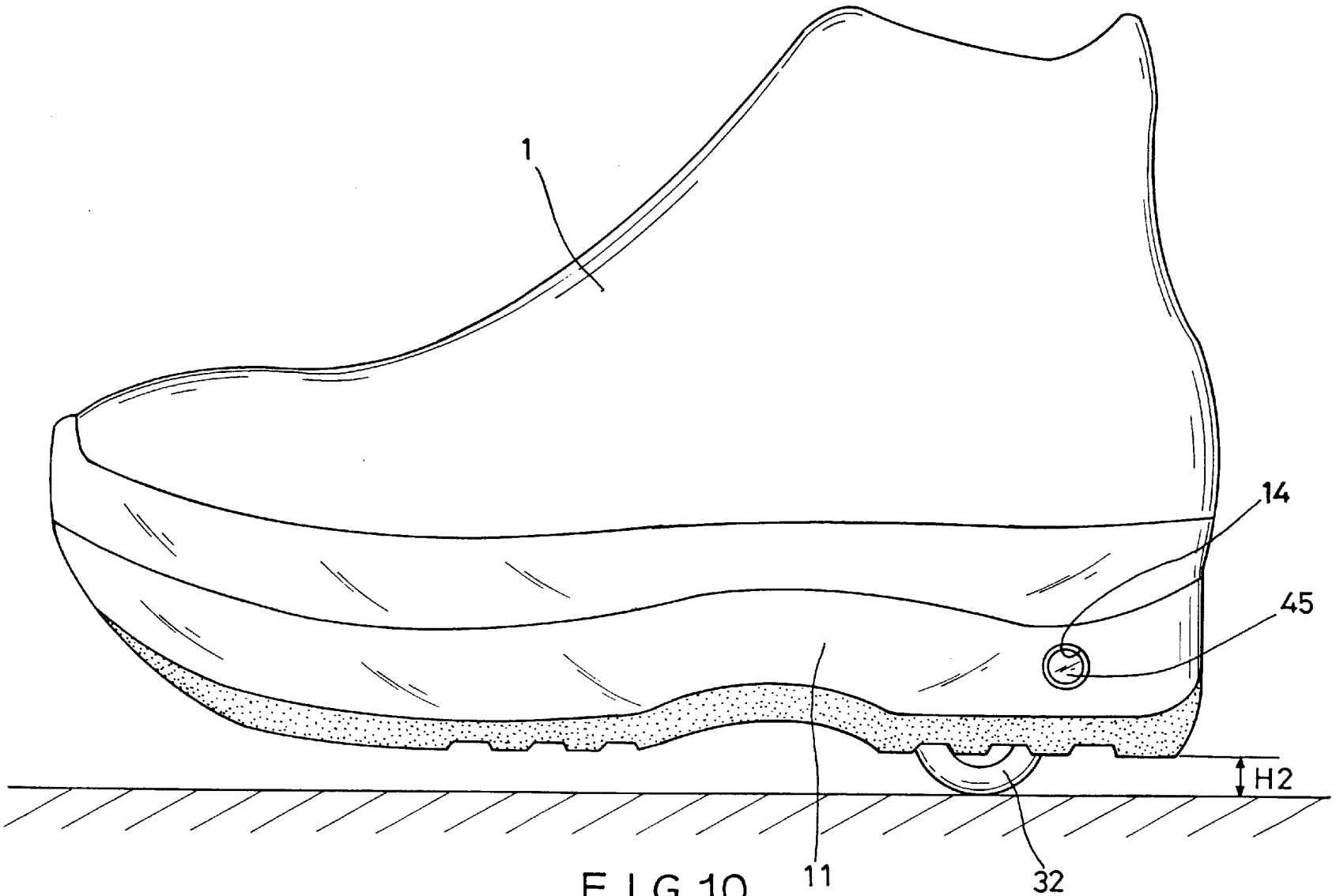
FIG. 10 is a side view of the third embodiment of the present invention.
Figure 13:
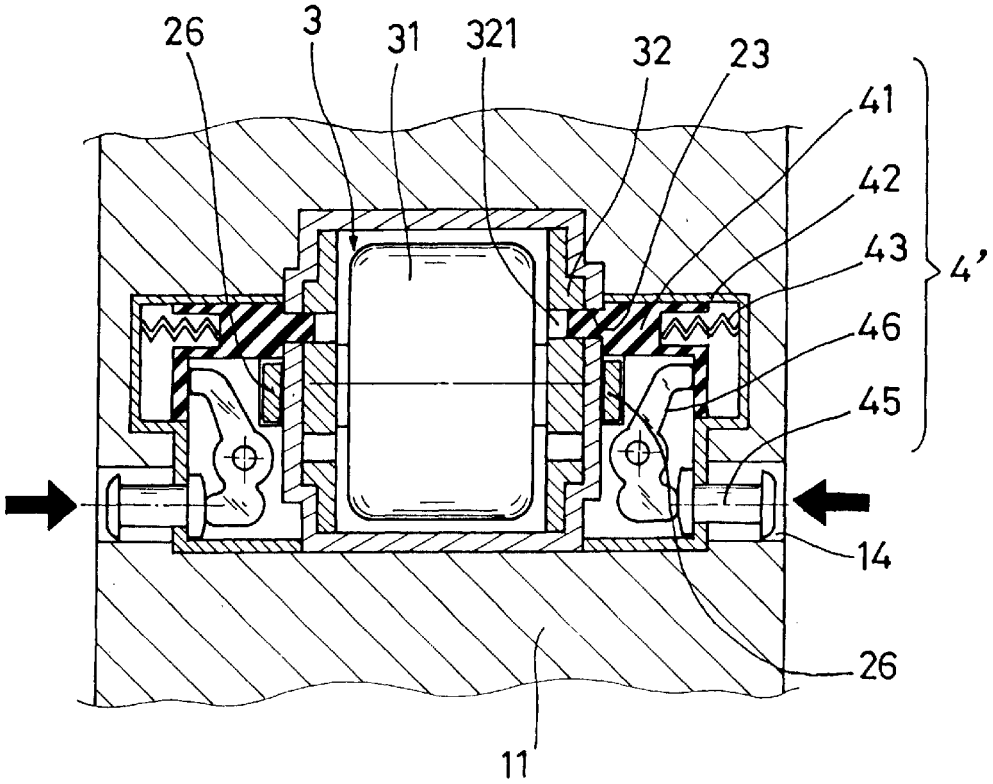
FIG. 13 is a section taken from the line 13—13 in FIG. 11.

Besides, the locating holes 321 of the sliding device 3 of the third embodiment are disposed at the right and left sides of the wheel base 32. If the arrangement is identical with that of the first embodiment, the locating holes 321 can be fitted to the front and rear sides of the wheel base 32. However, the locking device 4 has to be fitted in accordance with the position of the locating hole 321 to the rear, left and right sides. Moreover, the through hole 23 of the locating part 2 also has to be arranged in accordance with the position of the lock pin 41 of the locking device 4. In order to adjust to the space of the sole 11 and to achieve the convenience in operation, the casing 42 of the locking device 4 can be optionally shaped. The locking device 4', as illustrated in FIG. 9, is disposed at the right and left sides of the locating part 2. Only one locking device 4' is enough, and two are certainly more stable for the whole effect. The locking device 4', as illustrated in FIG. 13, contains a knob 45 used to push against a turning piece 46 to control a lock pin 41 to axially move while the knob 45, the turning piece 46 and the lock pin 41 are fixed by a casing 42. A spring 43 is interposed between the casing 42 and the lock pin 41, and the knob 45 is located in a through hole 14 at the side of the sole 11.

Figure 11:
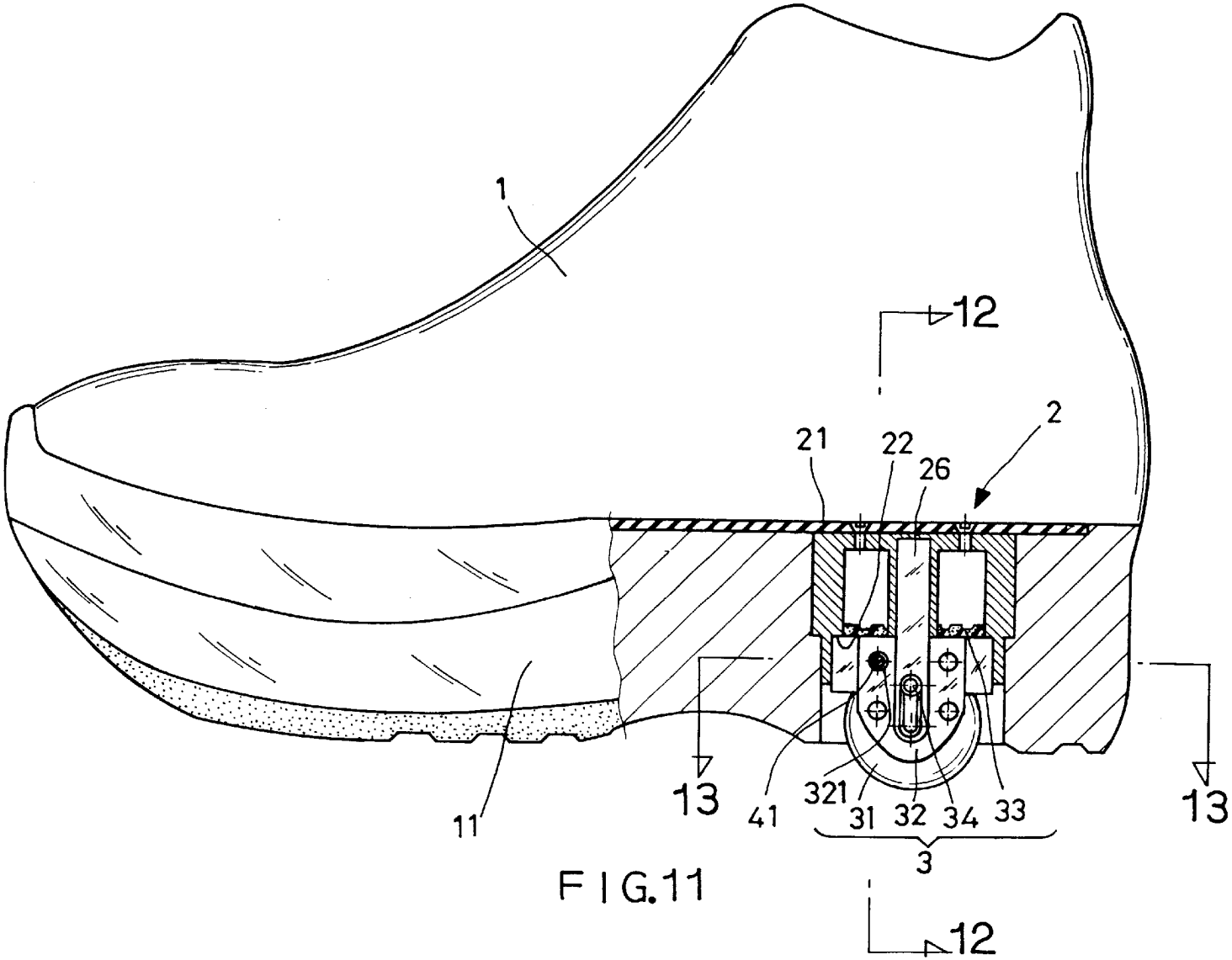
FIG. 11 is a partial section of the third embodiment of the present invention.
Figure 12:
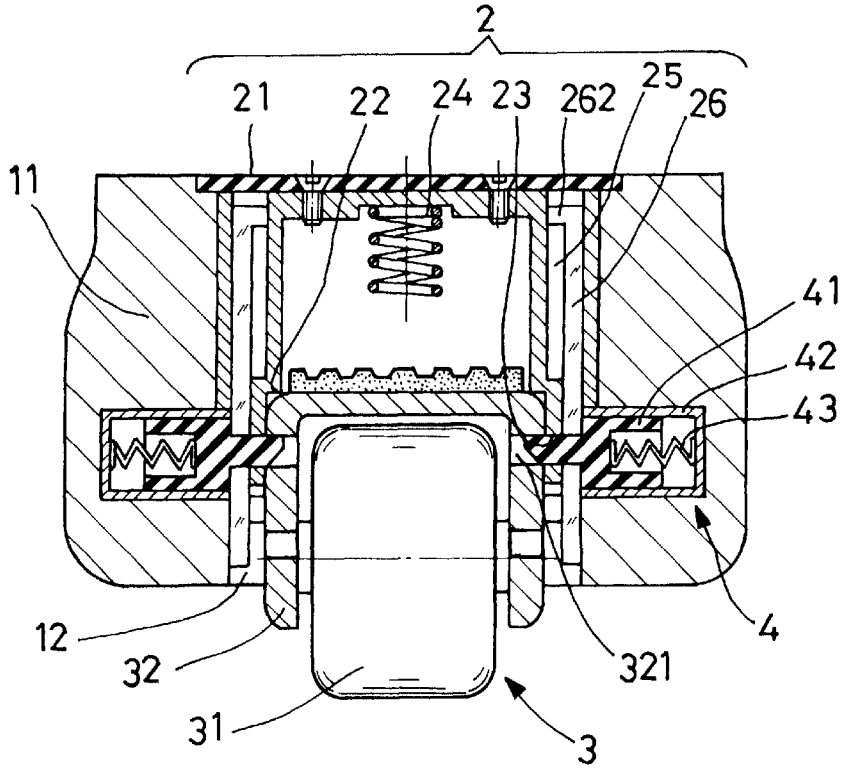
FIG. 12 is a section taken from the line 12—12 in FIG. 11.

Returning to the FIG. 10, a side view of the third embodiment of the present invention, showing that the knob 45 is located in the through hole 14 at the side of the sole 11 while the sliding device 3 is fixed in a slidable state. FIG. 11 is a partial section of the FIG. 10. In FIG. 11 it is seen that the sliding device 3 is fixed by the lock pin 41 inside the locating part 2 while the mounting rods 26 are connected by screws 34 with the wheel base 32. FIGS. 12 and 13 are respective sections taken along the lines 12—12 and 13—13, and the detailed structure is illustrated. The wheel 31 is directed downward and projects from the sole 11 in a slidable state. The lock pin 41 is inserted through the through hole 23 of the locating part 2 into the locating hole 321 of the wheel base 32 in position. In changing the location of the wheel 31, the knob 45 is pressed down while the lock pin 41 is returned by the turning piece 46 to the released state.

Figure 14:
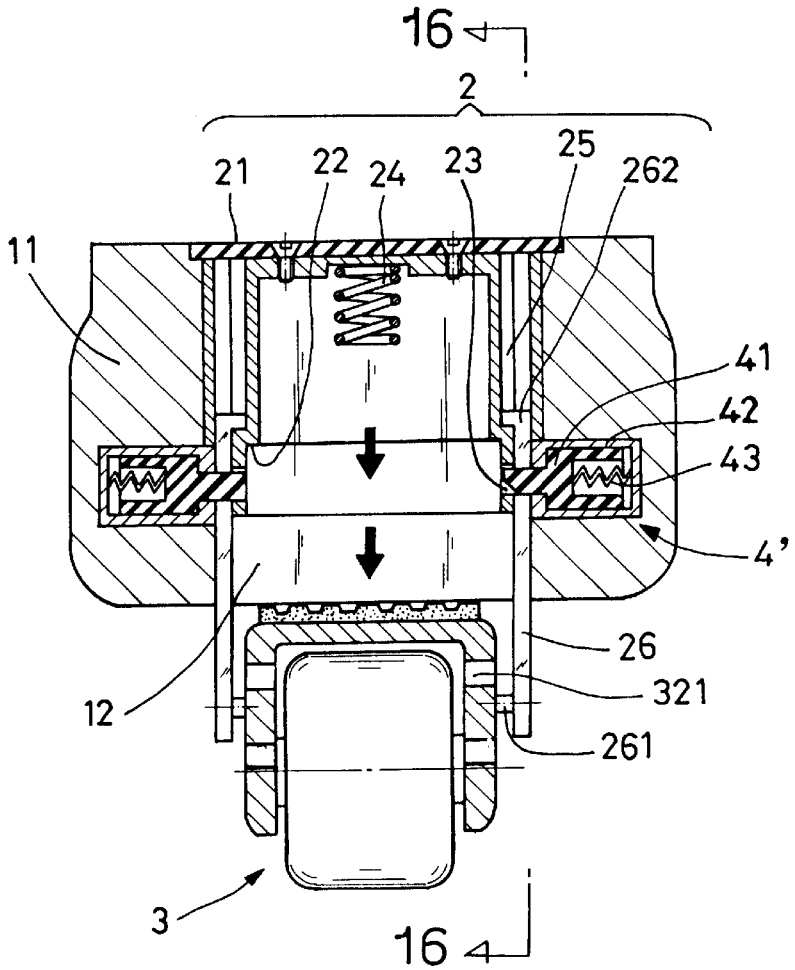
FIG. 14 is a first schematic drawing of the third embodiment of the present invention, showing the action in hiding the wheel thereof.
Figure 15:
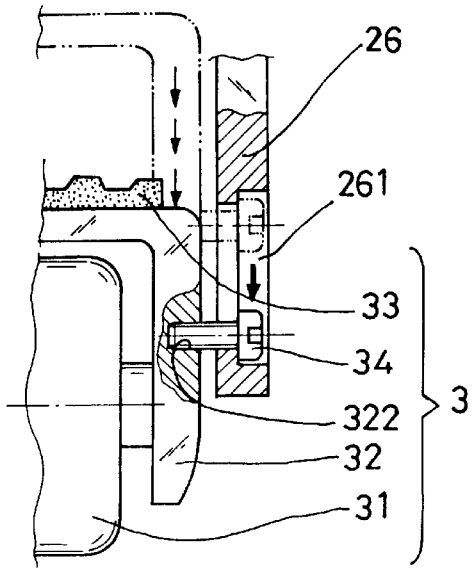
FIG. 15 is a second schematic drawing of the third embodiment of the present invention, showing the action in hiding the wheel thereof.
Figure 16:
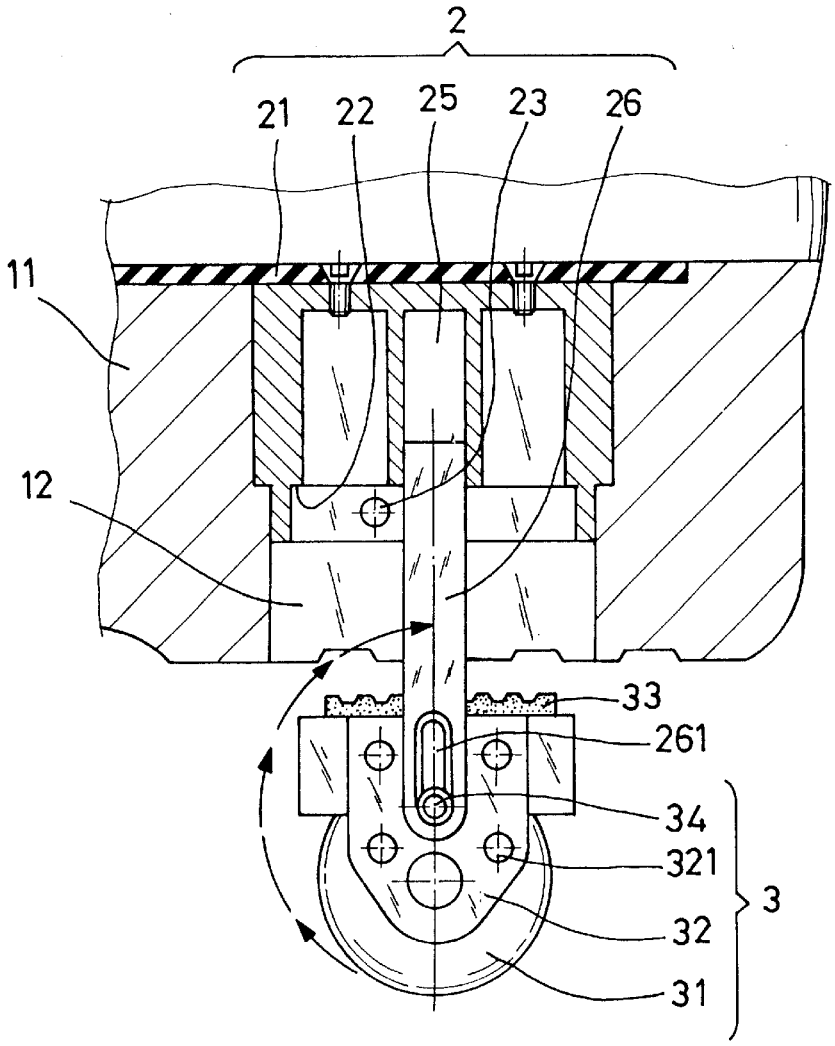
FIG. 16 is a section taken from the line 16—16 in FIG. 14.
Figure 17:
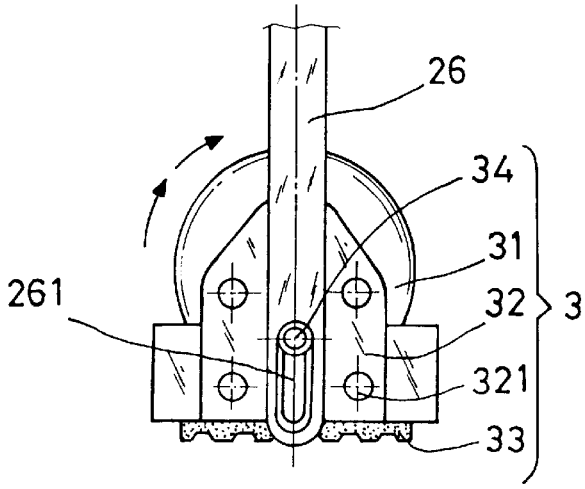
FIG. 17 is a third schematic drawing of the third embodiment of the present invention, showing the action in hiding the wheel thereof.
Figure 18:
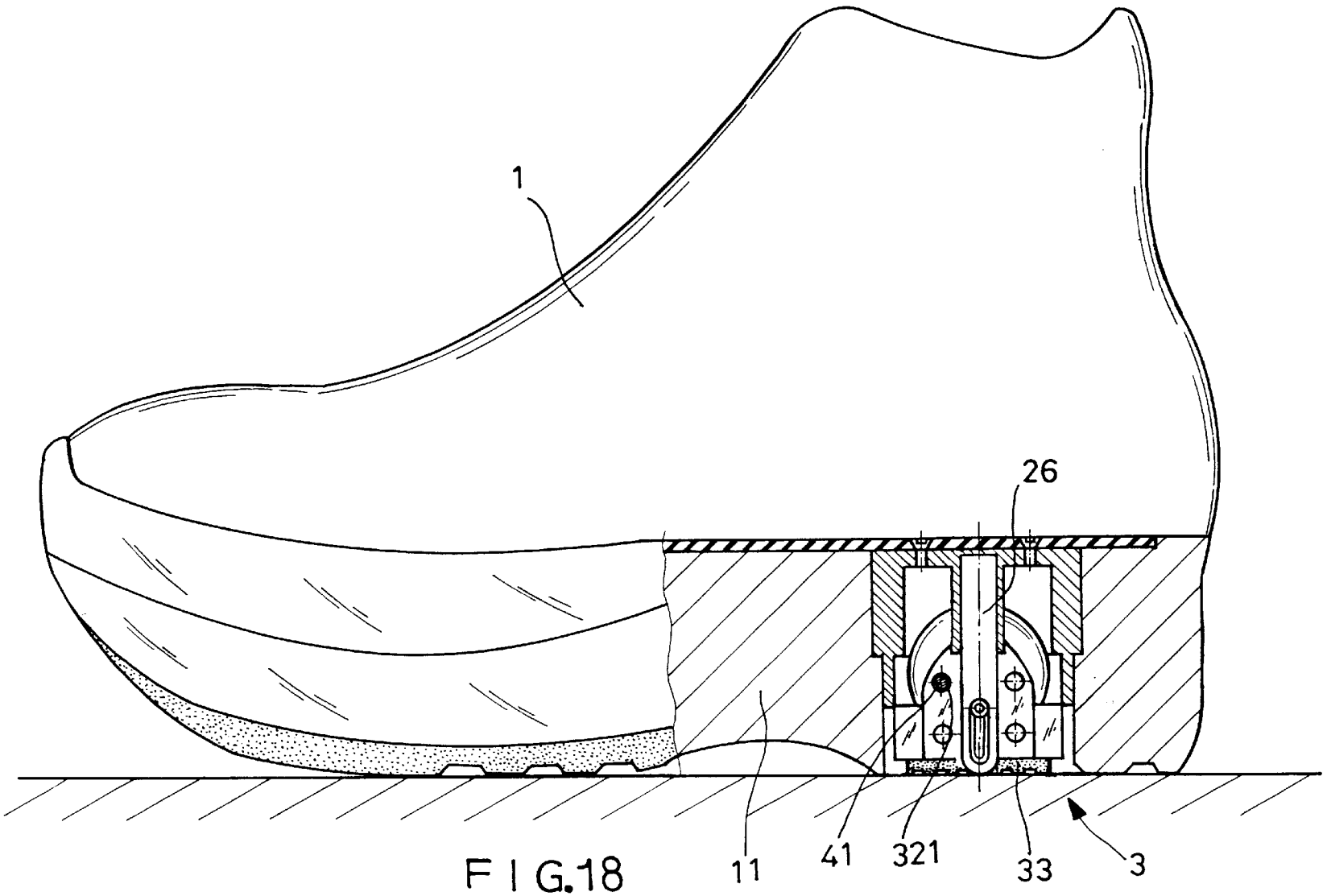
FIG. 18 is a partial section of the third embodiment of the present invention after the wheel is hidden in position.

As shown in FIGS. 14 and 15, the sliding device 3 falls along the slot 261 of the mounting rods 26 when released. Meanwhile, the mounting rods 26 will also simultaneously fall down and fastened by means of a hook 262 at the bottom of the longitudinal through hole 25 in such a way that the sliding device 3 has room to turn upside down (see FIGS. 16 and 17). The wheel 31 of the sliding device 3 turned upside down, as shown in FIG. 18, will be pushed into the locating part 2. Thereafter, the lock pin 41 is inserted into the locating hole 321 to return to the locked state. Accordingly, the sliding device 3 is hidden inside the sole 11 to have the walking function.

Through the technique of the above-mentioned embodiment of the present invention, the sliding device 3 can be rapidly assembled with the sole 11 in a sliding state or in a storage (disassembled) state. Thus, the operation is easy and convenient while the structure of the present invention is stable. Also, it's safe when sliding. In addition, the sliding function will support the beginner to train his sense of balance for enhancing the exercise fun. Consequently, it's a convenient, practical and multifunctional shoe.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A multifunctional shoe comprising:

a shoe having a sole provided with at least an accommodation in a prearranged position thereof;

a locating part fixed by a fixing member inside said accommodation and constructed as a hollow body with an opening directed downward, thereby forming a mounting opening at the bottom of said sole, a locating surface being disposed at a preset height on the inner wall of said locating part, a through hole being arranged at a side near the bottom of said locating part;

a sliding device having a wheel and a wheel base, said wheel base corresponding to said locating part in form so that it can be received in said locating part in contact against said locating surface, a locating hole corresponding to said through hole of said locating part being disposed at the side of said sliding device; and a locking device located at the side of said locating part, a lock pin being disposed inside said locking device and controllable from the outside of said sole to be axially moved into or retracted from said through hole of said locating part and said locating hole of said wheel base;

wherein said sliding device is fixed inside said locking device while at least a part of said wheel projects from said sole for sliding; moreover, the sliding device can be stored or disassembled without projection on said sole for walking.

2. The multifunctional shoe as claimed in claim 1, wherein a rubber cover is fitted to the mounting opening at the bottom of said sole.

3. A multifunctional shoe comprising:

a shoe having a sole provided with at least an accommodation in a prearranged position thereof;

a locating part fixed by a fixing member inside said accommodation and constructed as a hollow body with an opening directed downward, thereby forming a mounting opening at the bottom of said sole, a locating surface being disposed at a preset height on the inner wall of said locating part, a through hole being arranged at a side near the bottom of said locating part, a longitudinal through hole being disposed, respectively, at both sides thereof in which two mounting rods are freely moved up and down;

a sliding device having a wheel and a wheel base, said wheel base corresponding to said locating part in form so that it can be received in said locating part in contact against said locating surface, a locating hole corresponding to said through hole of said locating part being disposed at the side of said sliding device, said wheel base being fixed by screws in slots of said mounting rods at two sides of said locating part; and a locking device located at the side of said locating part, a lock pin being disposed inside said locking device and controllable from the outside of said sole to be axially moved into or retracted from said through hole of said locating part and said locating hole of said wheel base;

wherein said sliding device is fixed inside said locking device while at least a part of said wheel projects from said sole for sliding; alternatively, said wheel can be turned upside down to be pushed inward in a storage position for walking while no projection on said sole is present.

4. The multifunctional shoe as claimed in claim 1 or 3, wherein a spring is fitted to the inner top wall of said locating part.

5. The multifunctional shoe as claimed in claim 1 or 3, wherein a rubber pad is fitted to the top surface of said wheel base of said sliding device.

6. The multifunctional shoe as claimed in claim 1 or 3, wherein said locking device contains a lock pin axially movable in a casing and a spring being inserted on the middle part of said lock pin while said lock pin projects from said casing to create a holding head near a through hole at the side of said sole.

7. The multifunctional shoe as claimed in claim 1 or 3, wherein said locking device contains a knob used to push against a turning piece to control a lock pin to axially move while said knob, said turning piece and said lock pin are fixed by a casing, and wherein a spring is interposed between said casing and said lock pin, and said knob is located in a through hole at the side of said sole.

* * * * *